US006520496B2

(12) United States Patent
Müller et al.

(10) Patent No.: US 6,520,496 B2
(45) Date of Patent: Feb. 18, 2003

(54) APPARATUS AND PROCESS FOR TRANSPORTING SUPPLEMENTARY PRODUCTS

(75) Inventors: Erwin Müller, Dürnten (CH); Egon Hänsch, Wetzikon (CH)

(73) Assignee: Ferag AG, Hinwil (CH)

( * ) Notice: Subject to any disclaimer, the term of this patent is extended or adjusted under 35 U.S.C. 154(b) by 147 days.

(21) Appl. No.: 09/731,233

(22) Filed: Dec. 6, 2000

(65) Prior Publication Data

US 2002/0125630 A1 Sep. 12, 2002

(30) Foreign Application Priority Data

Dec. 7, 1999 (CH) ..... 1999 2241/99

(51) Int. Cl.[7] ..... B65H 29/00

(52) U.S. Cl. ..... 270/52.01; 271/185; 271/196; 156/568; 198/377.08

(58) Field of Search ..... 271/275, 276, 271/185, 196, 197; 198/377.08, 374; 270/52.01, 52.19; 156/568

(56) References Cited

U.S. PATENT DOCUMENTS 2,108,280 A * 2/1938 Wright ..... 198/374
4,050,574 A * 9/1977 Chenevard et al. ..... 271/196
4,696,715 A * 9/1987 Bahr ..... 271/276
5,489,360 A * 2/1996 Shimizu et al. ..... 271/276
5,535,999 A * 7/1996 Ford ..... 271/185
5,645,679 A 7/1997 Hansch
6,116,317 A * 9/2000 Tharpe et al. ..... 198/377.08
6,311,824 B1 * 11/2001 Van Pul ..... 198/377.08

FOREIGN PATENT DOCUMENTS

DE 29 01 800 * 7/1980 ..... 198/377.08
WO WO 99/06285 2/1999

* cited by examiner

*Primary Examiner*—H. Grant Skaggs
(74) *Attorney, Agent, or Firm*—Brinks Hofer Gilson & Lione

(57) ABSTRACT

The apparatus according to the invention, which serves for transporting supplementary products, in particular sheet-like printed products provided with adhesive, from a receiving location to a discharge location, has at least one retaining element which is moved along a continuous circulatory path and by means of which supplementary products can be gripped at the receiving location and released again at a discharge location. By means of a control arrangement, with changeover operation, during the transportation from the receiving location to the discharge location, the retaining element, which is mounted such that it can be rotated about an axis which is located at least more or less perpendicularly to the circulatory path, is optionally left unchanged in a rotary position or rotated about the axis through a certain angle until an end position of the transported supplementary product which is envisaged for further processing has been reached.

20 Claims, 10 Drawing Sheets

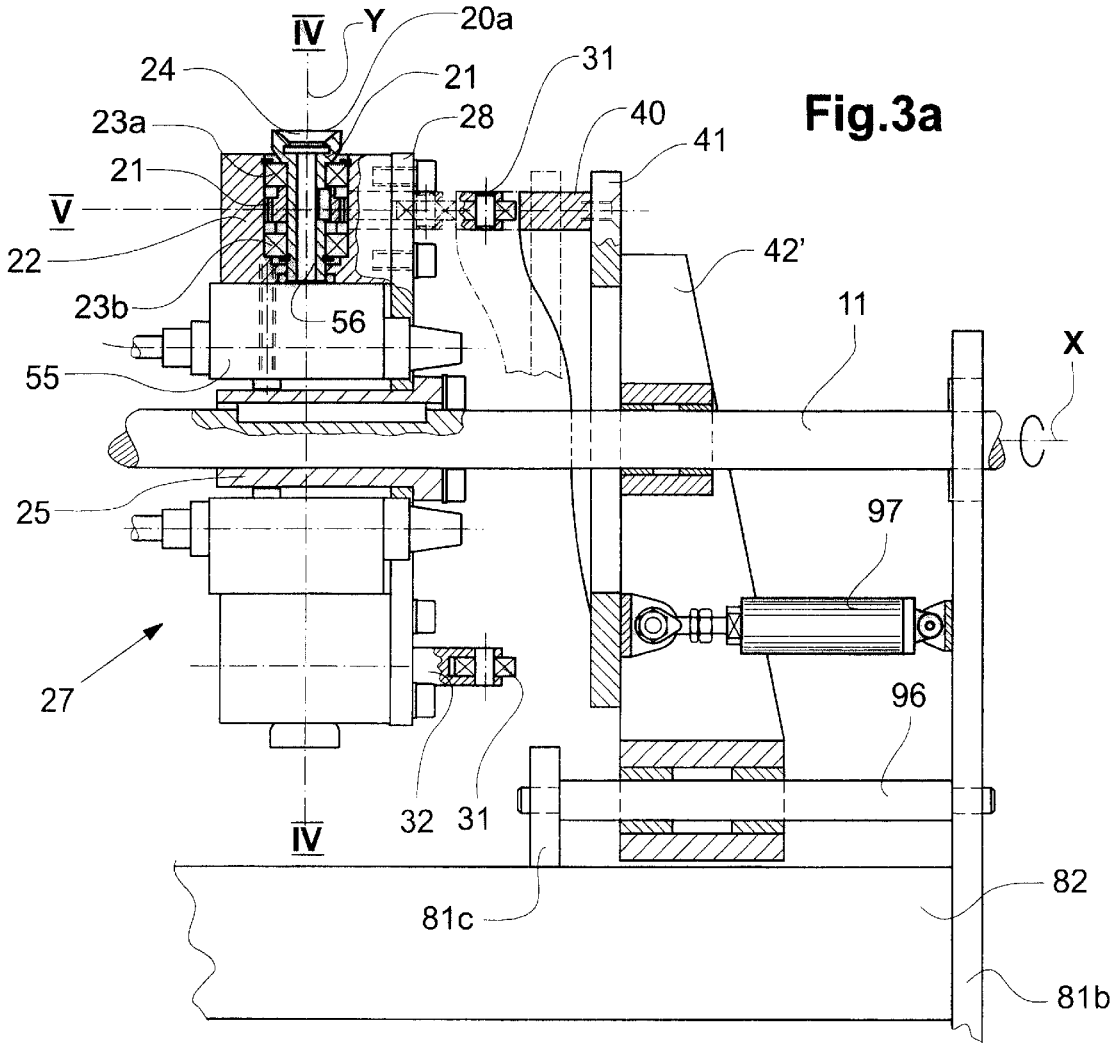
Fig.3a
Fig.5a
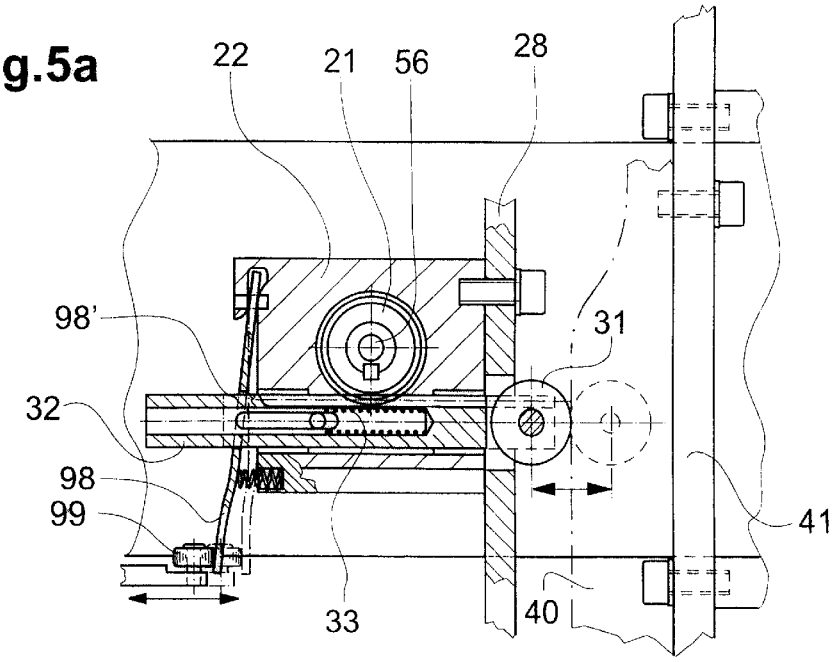

APPARATUS AND PROCESS FOR TRANSPORTING SUPPLEMENTARY PRODUCTS

FIELD OF THE INVENTION

The invention relates to an apparatus and to a process for transporting sheet-like supplementary products, provided in particular with adhesive, from a receiving location to a discharge location.

BACKGROUND OF THE INVENTION

During the processing, in particular during the collection, of printed products, it is often the case that supplementary products, such as labels, trade stamps or post-it® products, are to be provided in or on the printed products. The supplementary products may be present, for example, in a stack or separated off from a band or strip which is present in roll form. This band may be a carrier band, the supplementary products adhering thereto, being detached therefrom during the conveying operation, being gripped by an apparatus of the generic type and transported to the discharge location and then connected to the printed products directly, or if appropriate also by a further tool. The strip or the band, however, may also form the basis of the supplementary products, which are separated off from the strip and, if appropriate, processed further, and, if appropriate, are provided with an adhesive.

If an adhesive layer is required for the fed supplementary products, this is normally provided laterally, in relation to the conveying direction, on the supplementary products in the form of a strip. This is because the operation of applying a longitudinally continuous adhesive strip to a band is considerably more straightforward than applying, section by section, transverse strips which, in addition, have to be synchronized with a severing tool. It is also the case when a carrier band is used that supplementary products adhering thereto are preferably provided laterally, as seen in the conveying direction, with a strip-forming adhesive layer. As soon as the carrier band is guided, for example, around a detachment edge forming an acute angle, the supplementary products, which are coated with an adhesive, continue in the conveying direction, while being detached from the carrier band in the process.

While the operation of feeding supplementary products provided laterally with an adhesive strip is advantageous, supplementary products which are provided laterally with an adhesive strip can only be connected correctly to printed products with the corresponding high level of outlay. It is often thus practice to use apparatuses in which the transporting direction of the supplementary products is changed within the conveying operation, with the result that, following the changeover, the edge which butts against the adhesive strip trails in relation to the new transporting direction.

Such an apparatus is known from PCT publication number WO 99/06285. This document discloses a feed conveyor by means of which a band which is provided laterally with an adhesive-layer strip is fed to a cutting apparatus, which severs supplementary products from said band. The severed supplementary products are fed, by means of a suction tool or of a roller, to a rotor which, by means of gripping or suction elements, grips said products laterally, in relation to the feed and/or longitudinal band direction, guides them to a discharge location and, there, connects them to a printed product and releases them. In this case, the conveying direction of the supplementary products on the feed conveyor is located perpendicularly to the plane in which the laterally gripped supplementary products are transported by the rotor and also to the plane in which the printed products which are to be provided with the supplementary products are guided tangentially past the rotor.

The supplementary products, which are provided laterally, in relation to the feed conveying direction, with a strip-forming adhesive layer, are thus gripped by the rotor such that that edge of the supplementary product which butts against the adhesive-layer strip trails in relation to the direction of circulation of the rotor.

However, a large amount of space is required according to PCT publication number WO 99/06285 for the mutual alignment of the feed conveyor for the supplementary products, of the rotor and of the conveyor for the printed products.

On account of the change in the transporting direction within the conveying operation, in addition, the individual transporting sequences have to be carried out with a high level of precision, for which purpose an increase in the transporting rate of said apparatus can only be realized with a high level of outlay.

SUMMARY OF THE INVENTION

The object of the present invention is thus to provide a high-performance apparatus which can be used universally and to specify a process, by means of which supplementary products which are fed by a first conveyor in a first position can be gripped, transported to a second conveyor and discharged there in a second position which is suitable for further processing.

The apparatus according to the invention, which is intended for transporting supplementary products, in particular printed products provided with adhesive, from a receiving location, provided at a first conveyor, to a discharge location, provided at a second conveyor, can be used universally since the conveying directions of the first and second conveyors can be selected as desired. The change in position of the supplementary products which is necessary for the discharge to the second conveyor takes place here by way of the transporting apparatus according to the invention.

In a preferable configuration of the invention, the conveying direction of the first and second conveyors and of the transporting apparatus according to the invention are located in one plane, with the result that the space requirement alongside the conveyor provided for the printed products is minimal.

Since the entire conveying operation, according to the invention, can take place in one conveying direction or at least within one plane, with easily manageable transitions between the individual conveying apparatuses, it is also possible to realize high transporting rates with a low level of outlay.

BRIEF DESCRIPTION OF THE DRAWINGS

The invention is explained in more detail hereinbelow by way of exemplary embodiments, with reference to the drawing, in which:

FIG. 3*a* shows an illustration corresponding to FIG. 3, with a second variant of a control arrangement;

FIG. 5*a* shows an illustration corresponding to FIG. 5, with a third variant of a control arrangement;

DESCRIPTION OF THE PREFERRED EMBODIMENTS

Figure 1:
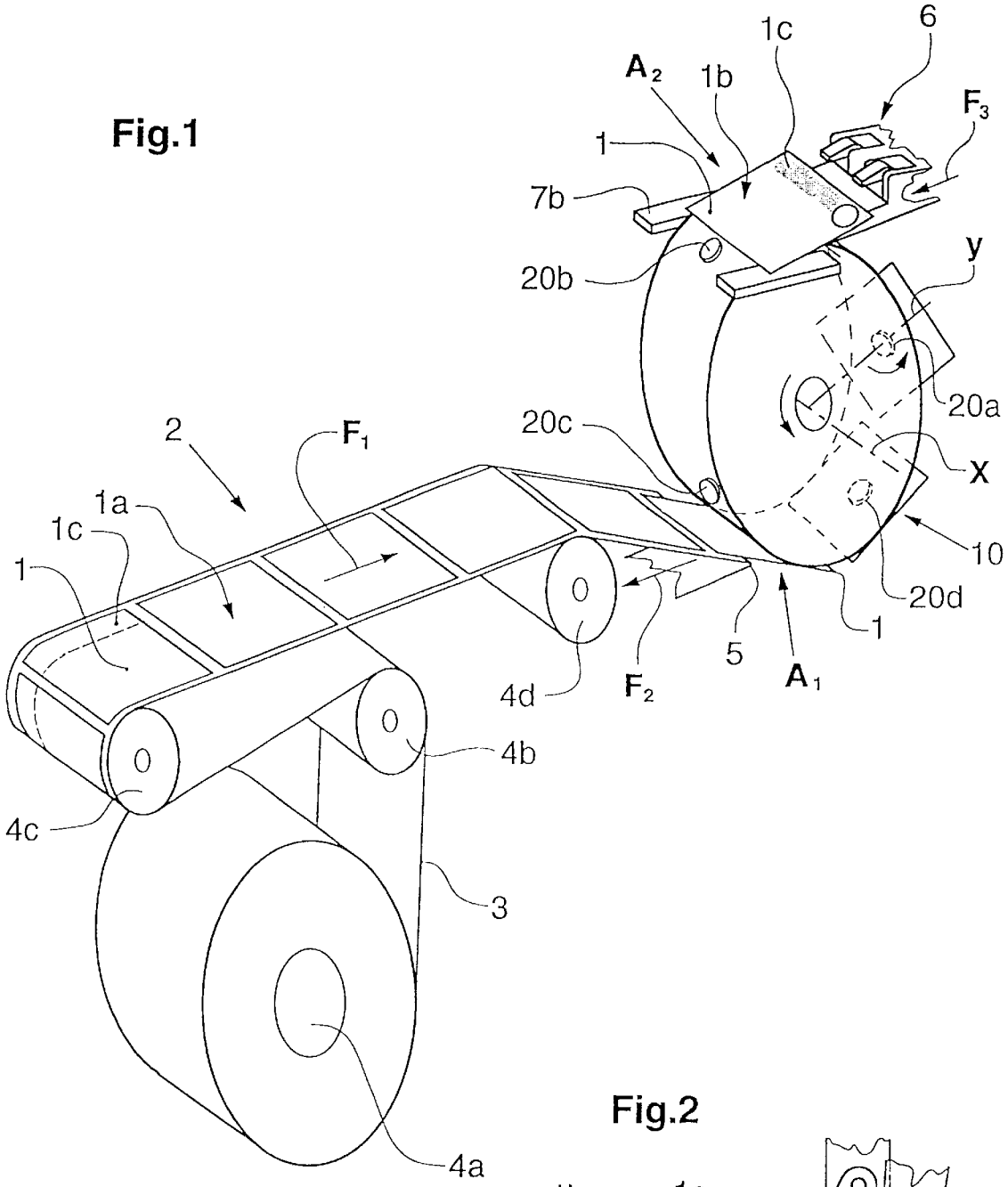
FIG. 1 shows a perspective illustration of a transporting apparatus according to the invention which is fed, by a first conveyor, supplementary products which, following the transportation and, if appropriate, a change in position, are gripped by a transporting clamp of a second conveyor.
Figure 6:
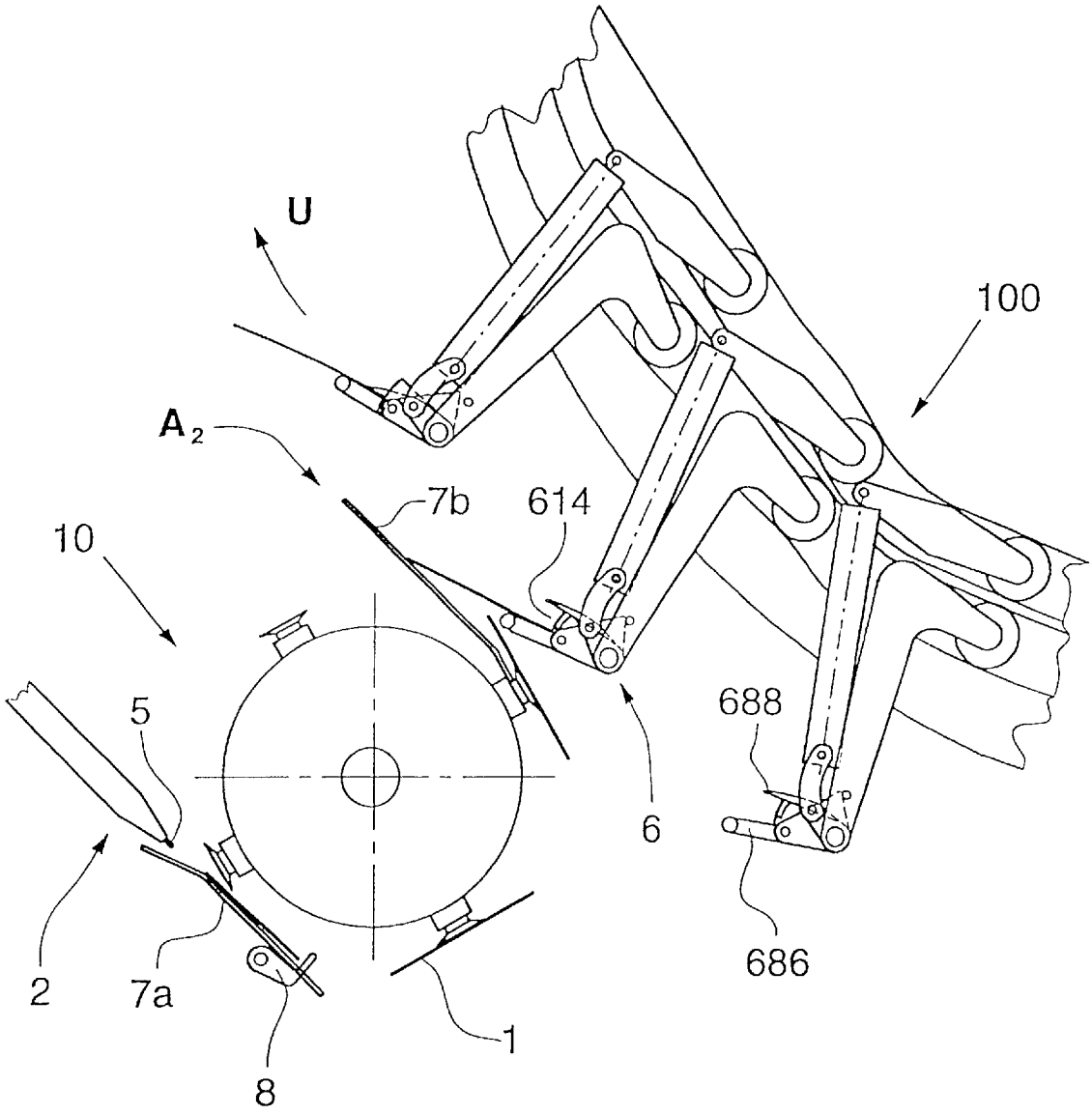
FIG. 6 shows a transporting apparatus according to the invention which receives supplementary products from a first conveyor and discharges them to a second conveyor.
Figure 7:
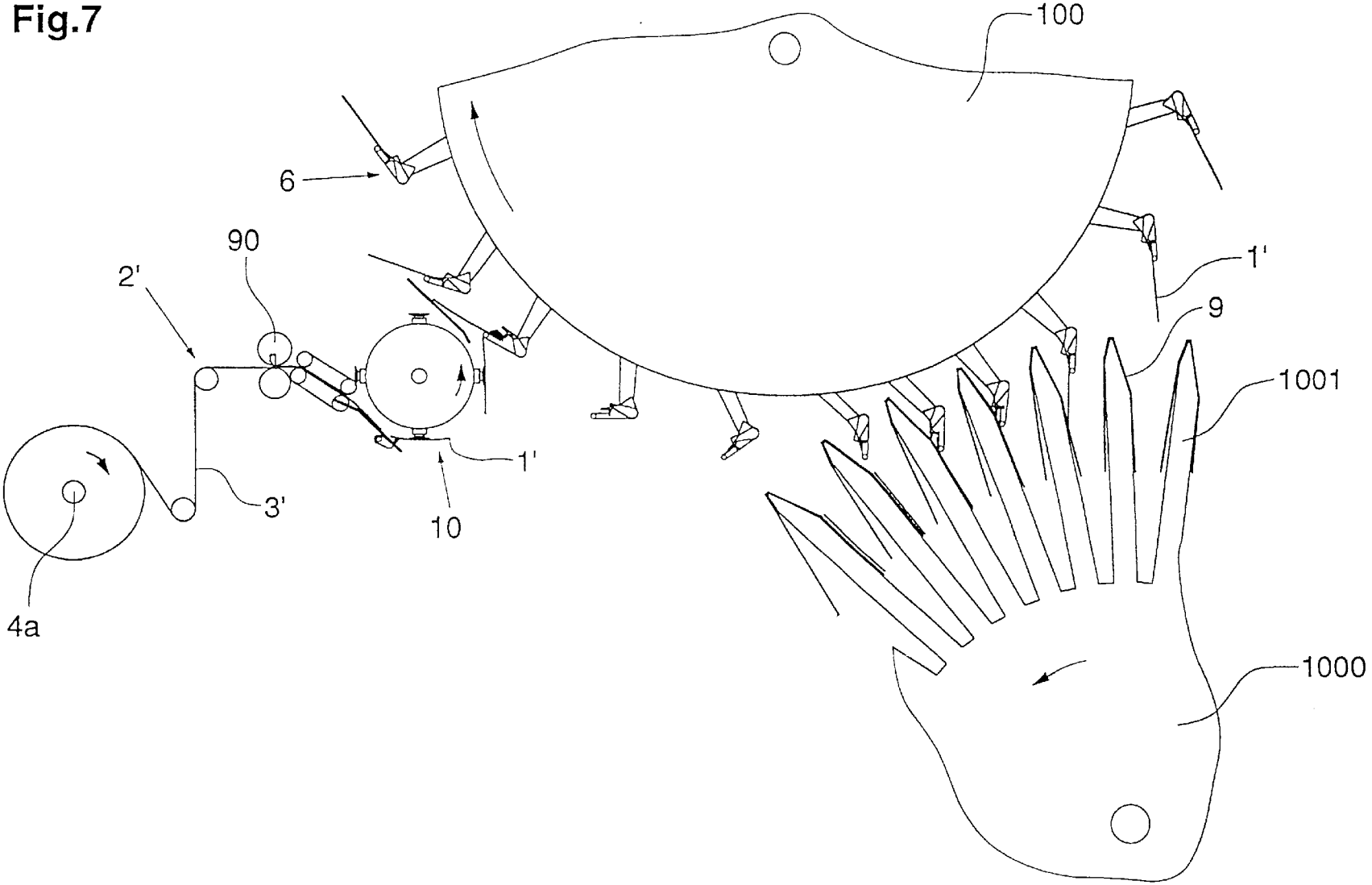
FIG. 7 shows the transporting apparatus from FIG. 6 interacting with a processing arrangement in which printed products which are to be provided with supplementary products are arranged.

FIG. 1 shows a schematic illustration of a transporting apparatus 10 according to the invention which is fed, by a feed conveyor or a first conveyor 2, supplementary products 1 which are gripped by retaining elements 20*a*, . . . , 20*d* of the transporting apparatus 10 at a receiving location A1 and, following the transportation, are fed to a transporting clamp 6 of a second conveyor 100 at a discharge location A2 (see FIGS. 6 and 7). The second conveyor 100, which is shown here by way of example, and the transporting clamp 6 are described in detail in U.S. Pat. No. 5,645,679.

In FIG. 7, the supplementary products 1 directly form the band or strip material 3', which is unwound from a spindle 4*a* and fed to a cutting arrangement 90, which severs supplementary products 1 from the strip material 3' and feeds them to the transporting apparatus 10.

The conveying directions of the first and second conveyors 2, 100 and of the transporting apparatus 10 according to the invention are located in one plane here. The necessary change in position of the supplementary products 1 takes place, as is yet to be described in detail hereinbelow, by a rotation of the retaining elements 20*a*, . . . , 20*d*.

The first conveyor 2, of which the conveying direction is designated F1, serves for supplying supplementary products 1 which are fastened on a carrier band 3 by means of an adhesive layer 1*c*. The adhesive layer 1*c* is provided on the left-hand side border of the supplementary products 1 in the form of a strip running in the conveying direction F1. The carrier band 3 is unwound from a supply roll, mounted by means of a spindle 4*a*, and is guided around deflecting rollers 4*b*, 4*c* and 4*d* to the receiving location A1. At the receiving location A1, the carrier band 3 is guided around a detachment edge 5 at an acute angle, with the result that the supplementary products 1 are detached from the carrier band 3 and continue in the feed direction F1. The carrier band 3, which is freed from the supplementary products 1, is drawn in a direction F2, counter to the feed direction F1, and disposed of.

With a feed advancement of the supplementary products 1 which is coordinated with the transporting speed of the transporting apparatus 10, said supplementary products may be transferred dynamically, i.e. without a reduction in speed and intermediate storage, in a precise manner to the retaining elements 20*a*, 20*b*, etc. of the transporting apparatus 10. Analogously to this, it is preferably also the case that the conveying speed of the second conveyor 100 is adapted to the transporting speed of the transporting apparatus 10. This results in a smooth transfer, which is not slowed down in practice, of the supplementary products 1 between the individual apparatuses.

Figure 8A:
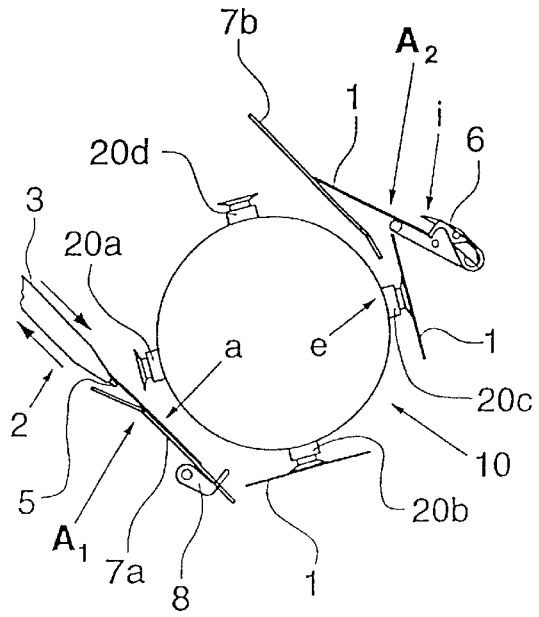
FIGS. 8*a–d* show the transporting apparatus from FIG. 6 during different phases of the transportation of supplementary products.
Figure 8B:
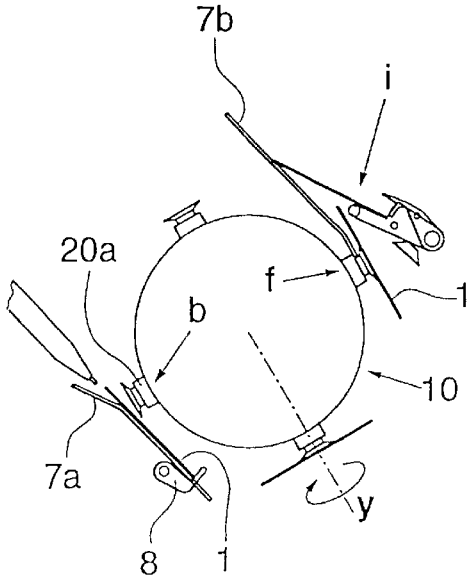
Figure 8C:
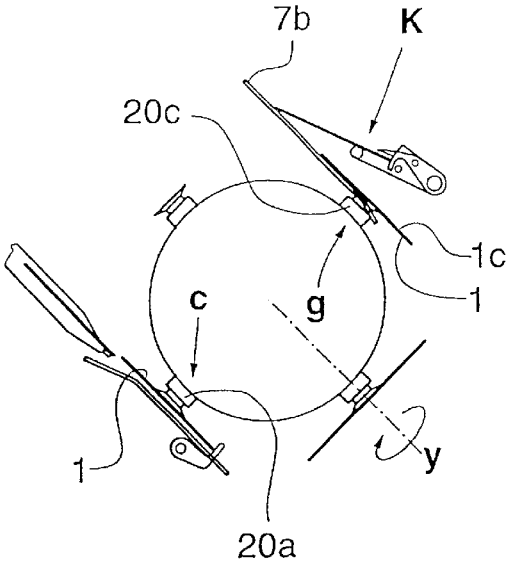
Figure 8D:
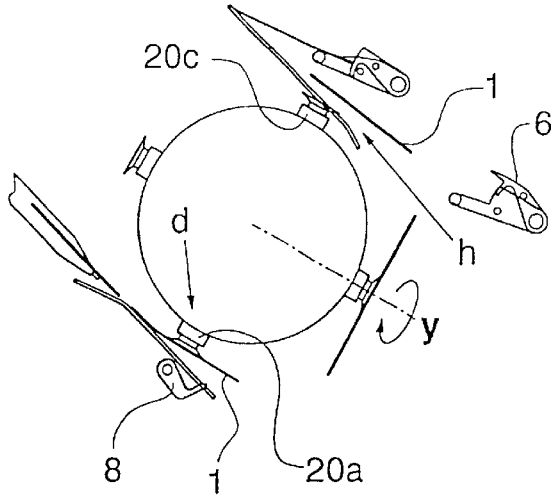

It can also be seen from FIG. 6 that, before being gripped by the retaining element 20*a*, the supplementary products 1 are stored on an intermediate basis on a bearing element 7*a* and are retained by a locking element 8, which releases the corresponding supplementary product 1 once it has been gripped by the retaining element 20*a* (see FIG. 8*d*). The adhesive layer 1*c*, which remains on the supplementary product 1, is located on the underside 1*b* of the supplementary product 1 resting on the bearing element 7*a*.

The supplementary product 1, which is fed on the bearing element 7*a*, is gripped on its top side 1*a* by the retaining element 20*a* and transported about an axis x to the discharge location A2, and released there on a further bearing element 7*b*, with the underside 1*b* and the exposed adhesive layer 1*c* in a radially outward direction.

The retaining element 20*a*, which is driven in the direction of circulation about the first axis x, is additionally mounted such that it can be rotated about a second axis y, which is located at least more or less perpendicularly to the first axis x and rotates with the retaining element 20*a* about the first axis x. During the transportation from the receiving location A1 to the discharge location A2, the supplementary product 1 is rotated about the axis y, with the result that said supplementary product can be discharged to transporting clamp 6 of the second conveyor 100 at the discharge location A2 in the position which is required for further processing. In the present exemplary embodiment, the supplementary products 1 are rotated through 90° in the clockwise direction, with the result that that edge of the supplementary products 1 which butts against the adhesive layer 1*c* trails, in relation to the conveying direction F3 of the second conveyor 100, at the discharge location A2.

Figure 2:
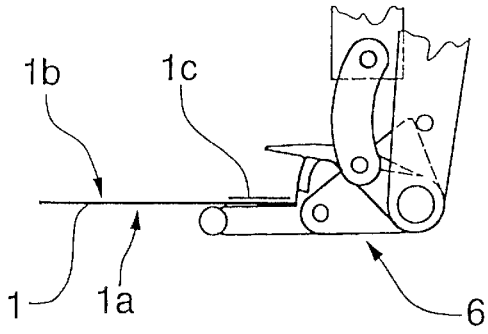
FIG. 2 shows a side view of the transporting clamp from FIG. 1 as it grips a supplementary product.

It can be seen from FIGS. 1 and 2 that the transporting clamp 6 grips the supplementary product 1 at the trailing edge and, as is shown in FIGS. 6 and 7, feeds it to a processing arrangement 1000 and/or to printed products 9 mounted therein.

Figure 3:
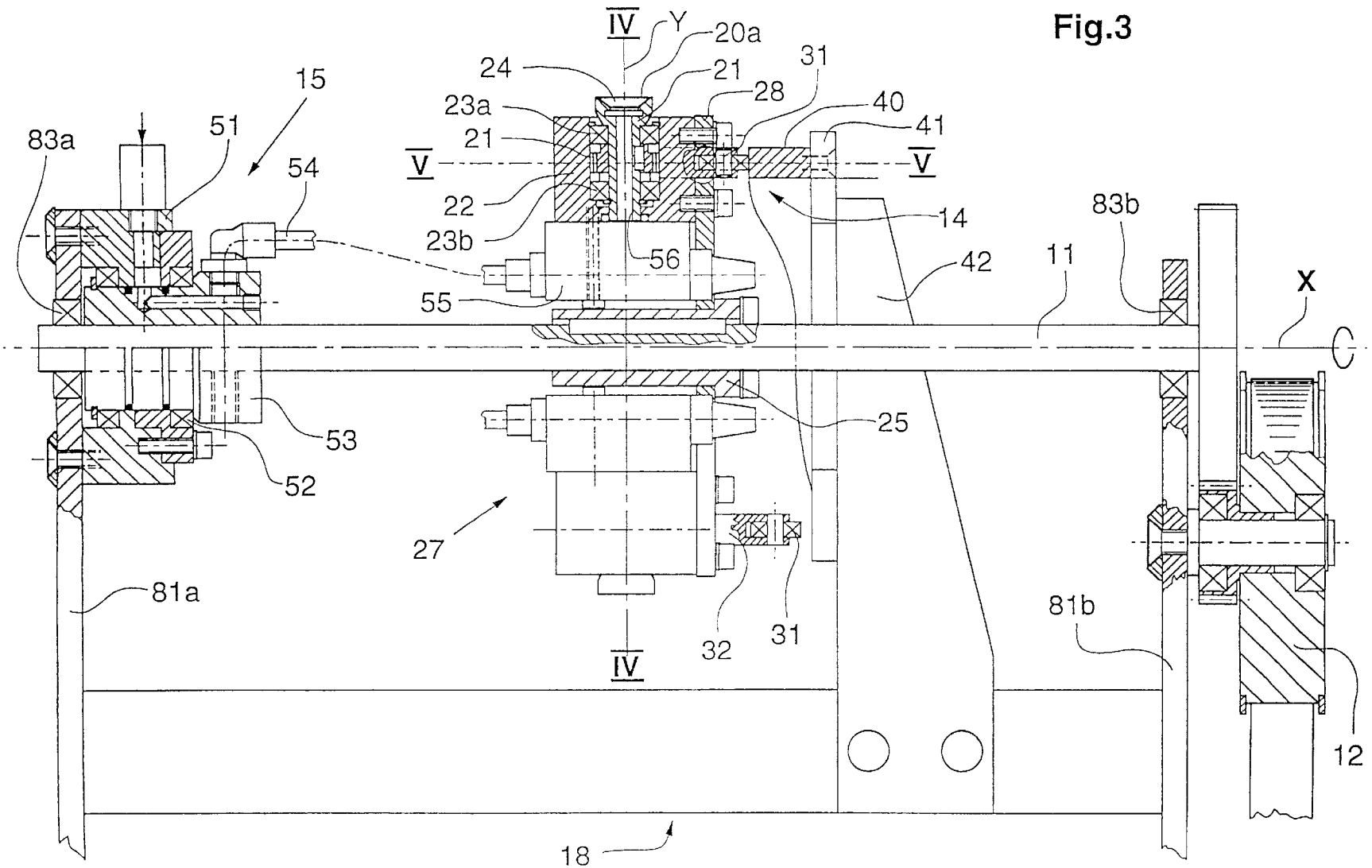
FIG. 3 shows a partially sectional view of a transporting apparatus according to the invention with drive and control arrangements.
Figure 4:
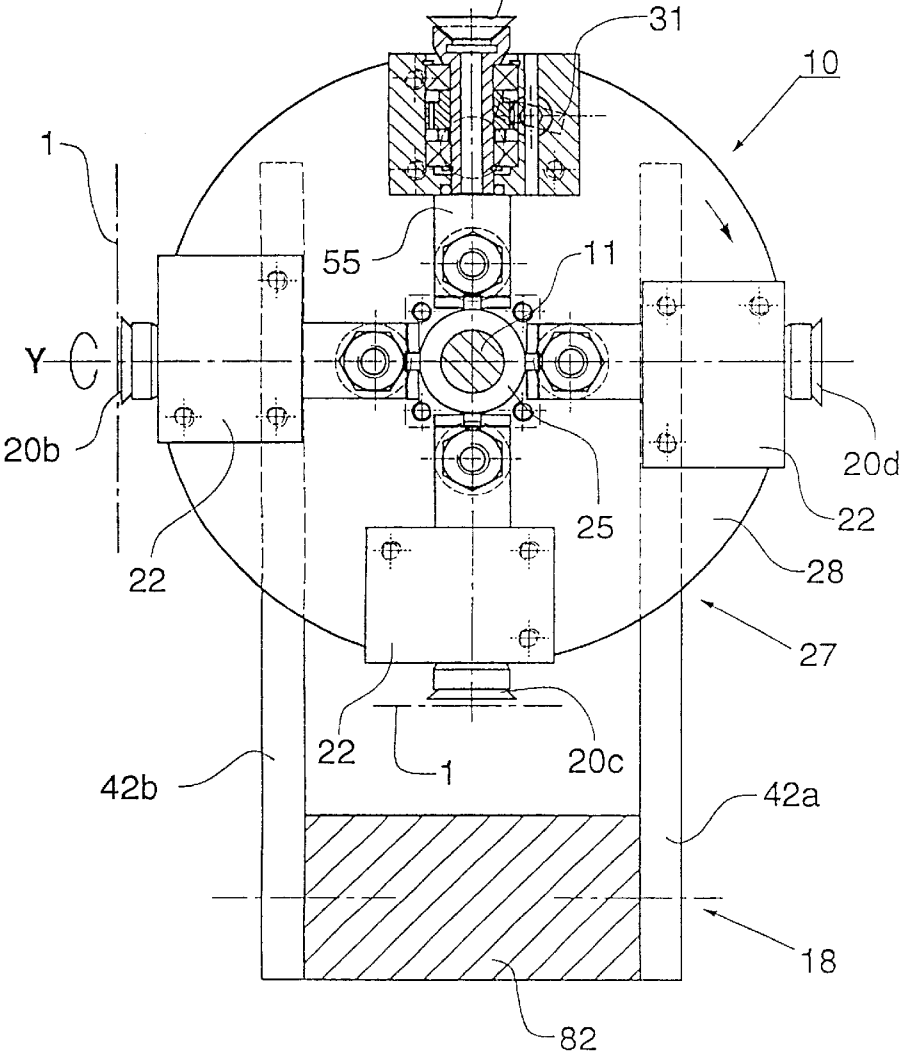
FIG. 4 shows a side view of the transporting apparatus according to the invention, partially in section along section line IV—IV depicted in FIG. 3.

FIG. 3 shows a preferable configuration of the apparatus 10 according to the invention with associated drive and control arrangements 12, 14, 15 in detail. FIG. 4 shows the apparatus according to the invention in a cross section along section line IV—IV depicted in FIG. 3. It can be seen from this that the transporting apparatus 10 has four retaining elements 20*a*, 20*b*, 20*c* and 20*d* which are configured as suction tools or suckers and are each mounted in a bearing body 22 such that they can be rotated about an axis y, which is located perpendicularly to axis x of the drive shaft 11. The bearing bodies 22 are connected to a rotor disk 28, if appropriate to rotor arms, which is fastened, by means of a flanged hub 25, on a shaft 11 aligned along the first axis x. The bearing bodies 22 and the rotor disk 28, connected to the flanged hub 25, thus form a rotor 27, which is driven by the shaft 11.

The retaining elements 20*a*, 20*b*, 20*c*, 20*d*, which are configured as suckers, have a hollow shaft 21 which is mounted rotatably in the bearing body 22 by means of two bearings 23*a* and 23*b*, is provided with an air channel 56 and of which the radially outwardly directed end is provided with a suction connection 24, which is suitable for gripping products 1 and the end which is directed toward the first axis x is inserted into an ejector 55, which is connected pneumatically to a controllable compressed-air apparatus 15 and serves as a jet pump with suction-extraction action. The compressed-air apparatus 15 comprises a rotary valve 53 which is seated on the shaft 11, is connected to in each case one ejector 55 in each case via one line 54 and is mounted rotatably in a stator 51 by means of a bearing 52 such that the air feed takes place in the stator 51 and an air channel is formed in the rotary valve 53 for each retaining element 20*a*, 20*b*, 20*c*, 20*d*. The air pressure (vacuum) within each hollow shaft 21 is controlled here in dependence on the position of the retaining elements 20*a*, 20*b*, 20*c*, 20*d*, with the result that a supplementary product 1 is attached by suction at the receiving location A1 and, following the transportation, released again at the discharge location A2. Instead of the abovedescribed compressed-air apparatus, by means of which the necessary suction action is produced in the ejectors 55 by increasing the flow speed, it is also possible to use a negative-pressure system, by means of which the air is extracted by suction from the corresponding channels as required.

Figure 5:
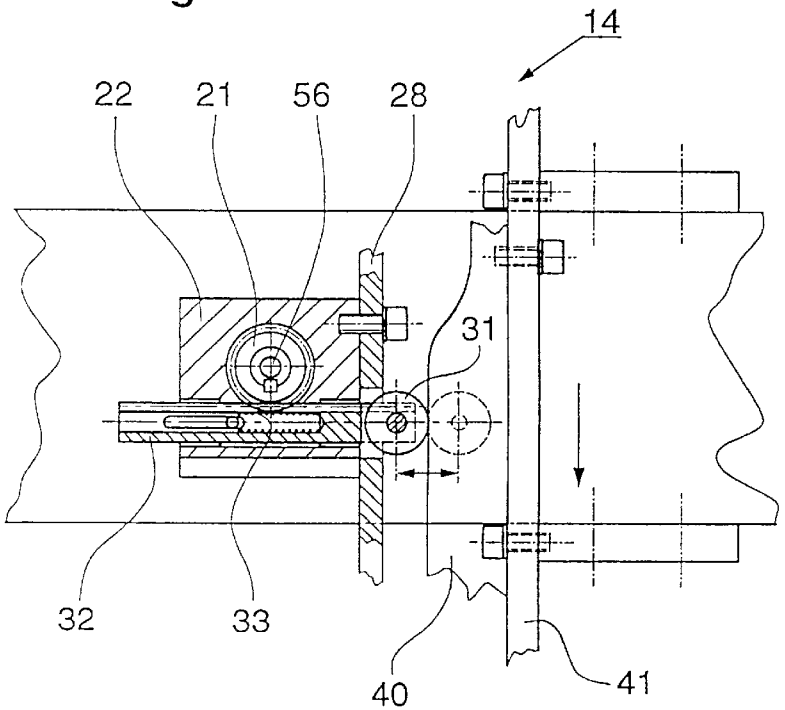
FIG. 5 shows the transporting apparatus according to the invention in a section along section line V—V depicted in FIG. 3.

FIG. 5 shows the transporting apparatus according to the invention in a section along section line V—V depicted in FIG. 3. The control arrangement 14, which is shown in detail therein, has, for each of the retaining elements 20*a*, 20*b*, 20*c*, 20*d*, a slide 32, which is mounted displaceably in the bearing bodies 22 of said retaining elements, and a guidance means 40, of which the surface is followed by means of a wheel 31 of the slide 32, the two being in contact with one another. In this case, the slide 32 has a tooth profile 33 which engages with a form fit in a radial toothing formation provided on the hollow shaft 21. A displacement of the slide 32 parallel to the first axis x thus causes a corresponding rotation of the hollow shaft 21, and thus of the retaining element 20*a*, 20*b*, 20*c*, 20*d*. The slide 32 is displaced in dependence on the surface of the guidance means 40, by means of which the rotation of the retaining elements 20*a*, 20*b*, 20*c*, 20*d* is thus defined in dependence on the angle of rotation of the shaft 11. The guidance means 40 is fastened on an installation panel 41 which is arranged parallel to the plane of rotation of the rotor 27 and is connected to a load-bearing structure 18 via at least one load-bearing element 42 (two load-bearing elements 42*a*, 42*b* are shown in FIG. 4). The load-bearing structure 18 has a base element 82 on which there are fastened the load-bearing element 42 (42*a*, 42*b*) and two supporting elements 81*a*, 81*b*, which are provided with bearings 83*a*, 83*b* serving for mounting the shaft 11. In addition, a part of the shaft drive 12 is fastened on the supporting element 81*b* (see FIGS. 3 and 4).

The second conveyor 100, which is shown in FIG. 6 and is described in detail, as has been mentioned, in U.S. Pat. No. 5,645,679, has individually controllable transporting clamps 6 which are arranged one behind the other, are driven in the direction of circulation U and are each provided with two clamping elements 686, 688 which, in a receiving section of the circulatory path, form a clamp mouth 614 which is directed at least more or less in the direction of circulation U. By virtue of each of the transporting clamps 6, in the receiving section, at the discharge location A2 of the transporting apparatus 10, in each case one supplementary product 1 is gripped at its trailing edge, as seen in the direction of circulation U, and then, as is shown in FIG. 7, discharged to printed products 9, which are arranged in a straddling manner on wall elements 1001 in the processing arrangement 1000.

The transfer of a supplementary product 1 from the first conveyor to the second conveyor 2, 100 by means of the transporting apparatus 10 according to the invention is described hereinbelow with reference to FIGS. 8*a* to 8*d*.

A carrier band 3 provided with supplementary products 1 is, as has been described above, guided around a detachment edge 5 at an acute angle, with the result that a supplementary product 1 is detached and deposited on the first bearing element 7*a* at the receiving location A1 (see a in FIG. 8*a*). Until it is received by the next-following retaining element 20*a*, the supplementary product 1, deposited on the bearing element 7*a*, is retained by the locking element 8 (see b in FIG. 8*b*). Once the supplementary product 1 has been gripped by the retaining element 20*a* (see c in FIG. 8*c*), the supplementary product 1 is released by the locking element 8 being swung downward (see d in FIG. 8*d*). During the transportation between the receiving location and discharge location A1; A2, the gripped supplementary product 1 is rotated, by means of the control arrangement 14, about the second axis y until that border of the supplementary product 1 which is provided with the adhesive layer 1*c* trails in relation to the direction of rotation of the rotor 27 (see g in FIG. 8*c*).

At e in FIG. 8*a*, the retaining element 20*c* has reached the discharge location A2 and then deposits the transported supplementary product 1 on the second bearing element 7*b* (see f in FIG. 8*b* and g in FIG. 8*c*). Once the supplementary product 1 has been deposited, it is released by the retaining element 20*c* (see h in FIG. 8*d*), with the result that, as is shown at i, j and k in FIGS. 8*a*–8*c*, it can be gripped, and guided away, by a transporting clamp 6.

FIGS. 9*a* to 9*d* show further methods of feeding and preparing supplementary products 1 which, for example as illustrated in FIG. 7, are connected to printed products 9. Instead of a carrier band 3 for the supplementary products 1, use is made, in FIGS. 9*a* and 9*b*, of a band 3' which has, on one border, an adhesive layer 1*c'* which runs continuously in the conveying direction. Upstream of the receiving location, the band 3' is divided up, by a cutting apparatus 90, into supplementary products 1' which, following the transporting operation, are connected to printed products 9, i.e. run through the transporting apparatus 10 without rotation.

Figure 9A:
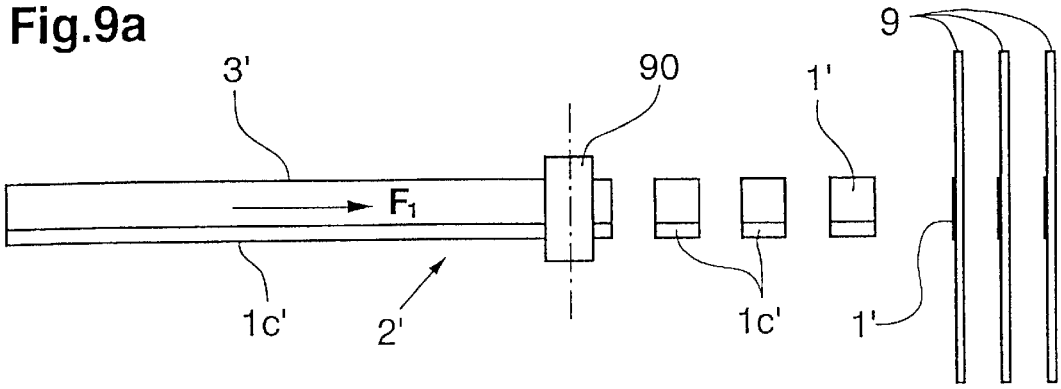
FIGS. 9*a–d* show the preparation of supplementary products and the arrangement thereof following their connection to a printed product deposited in the processing arrangement.
Figure 9B:
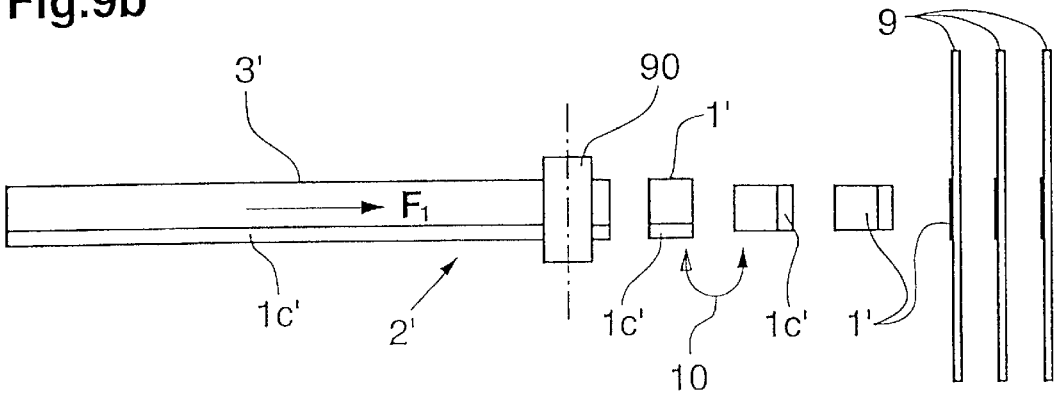
Figure 9C:
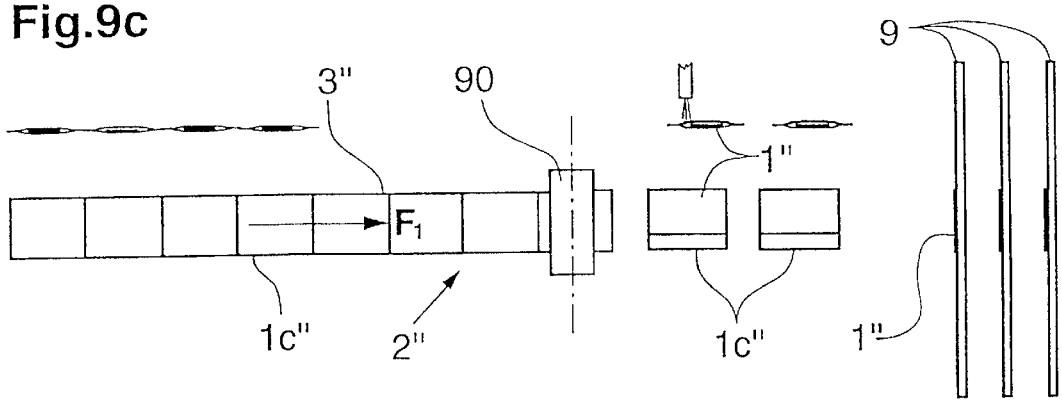
Figure 9D:
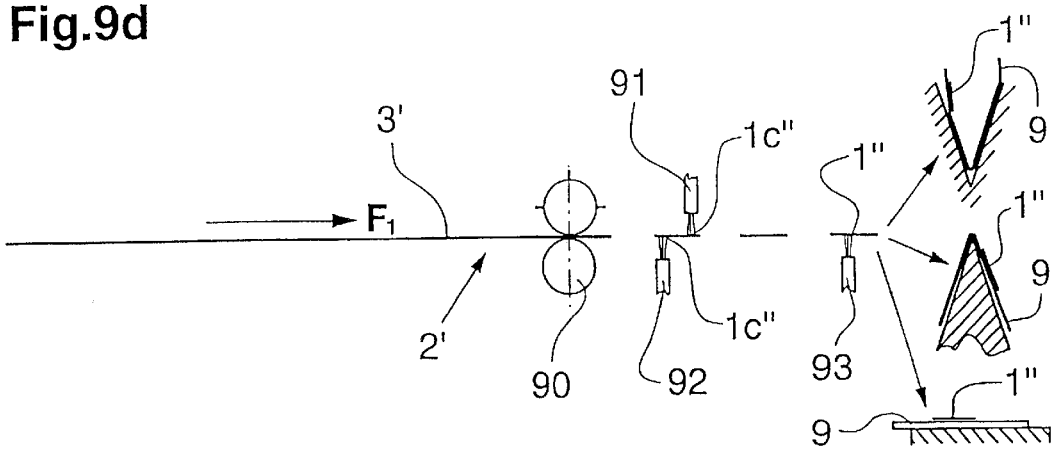

FIG. 9*d* shows that, during the transporting operation, the supplementary products 1' are rotated into a desired position by means of the transporting apparatus 10 according to the invention.

FIGS. 9*c* and 9*d* show a band 3" which is not provided with an adhesive layer and is divided by the cutting apparatus 90 into parts which, once they have been coated by means of adhesive dispensers 91, 92 and/or provided with text by means of a printing head 93 (e.g. ink-jet), form the supplementary products 1". The parts may be, for example, trade samples or sample packs which are joined together to form a band 3".

It can also be seen from FIG. 9*d* that printed products 9 which are to be provided with supplementary products 1 may be mounted in different ways in processing arrangements 1000. Since the transporting apparatus 10 according to the invention can supply the supplementary products 1 in the necessary position for any way of mounting a printed product, it can be used in a versatile manner not just in spatial, but also in functional, terms. Supplementary products 1 can be rotated about the second axis y at any desired angle and connected to the printed products 9, which, having been inserted in receiving gaps, collected in a straddling manner on wall elements or deposited on a conveying belt, are mounted in the processing arrangement 1000.

The necessary change in position of the supplementary products 1 as they run through the transporting apparatus 10, i.e. the rotation about the second axis y at a desired angle and in a desired direction of rotation, is determined by the shape of the guidance means 40. If the supplementary products 1 are to run through the transporting apparatus 10 without rotation, then it is possible for example—as is illustrated in FIG. 3*a*—for the guidance means 40 to be adjusted out of the position which is indicated by chain-dotted lines in FIG. 3*a*, in the direction of the first axis x, into the position which is depicted by a solid line, and in which the wheels 31 of said guidance means are located outside the engagement region, with the result that, during the transportation of the supplementary products 1 from the receiving location A1 to the discharge location A2, said products do not rotate about the second axis y. However, it is also possible for the guidance means 40 to be retained in an intermediate position between the two limit positions illustrated in FIG. 3*a* (chain-dotted lines—maximum rotation e.g. 90°, solid line—no rotation), as a result of which the desired angle of rotation for the supplementary products 1 is reduced.

In the exemplary embodiment illustrated in FIG. 3*a*, the installation panel 41, which is connected to the guidance means 40, is provided on a load-bearing element 42' which is arranged displaceably on the shaft 11, on the one hand, and, on the other hand, on a guide rod 96 which is parallel to the shaft 11. The guide rod 96 is borne by supporting elements 81*b*, 81*c* connecting to the base element 82. For adjustment of the installation panel 41, which is provided with the guidance means 40, a control cylinder 97 is arranged between the installation panel 41 and the supporting element 81*b*.

In a further control variant, which is illustrated in FIG. 5*a*, the slide 32, which interacts with the guidance means 40 via the wheel 31, can be blocked in a certain position corresponding to a certain angle of rotation of the retaining element 20 by means of of a catch 98 which is known per se and can remain in this position, even when the wheel 31 is disengaged from the guidance means 40. By means of a control element 99, the catch 98 can be adjusted into a position which is illustrated by chain-dotted lines in FIG. 5*a*, and the blocking, which is brought about by clamping between an opening 98' of the catch 98 and the slide periphery, is thus eliminated. This allows selectable individual rotation or non-rotation by means of the control element 99. It is also conceivable to rotate the guidance means 40 on the installation panel 41 about the shaft 11 such that the active region of the guidance means 40 is located outside the conveying region.

Both the design according to FIG. 3*a* and that according to FIG. 5*a* thus allow the control arrangement 14 to be switched off, switched on or switched over, with the result that the supplementary products 1 run through the transporting apparatus 10 with or without rotation, to be precise at a desired, adjustable angle.

Furthermore, it is, of course, also possible for the transporting apparatus 10 to be equipped with fewer, or more, than the four retaining elements 20*a*, . . . , 20*d* shown. The number of retaining elements 20 is preferably selected with account being taken of the size of the supplementary products 1.

Figure 6A:
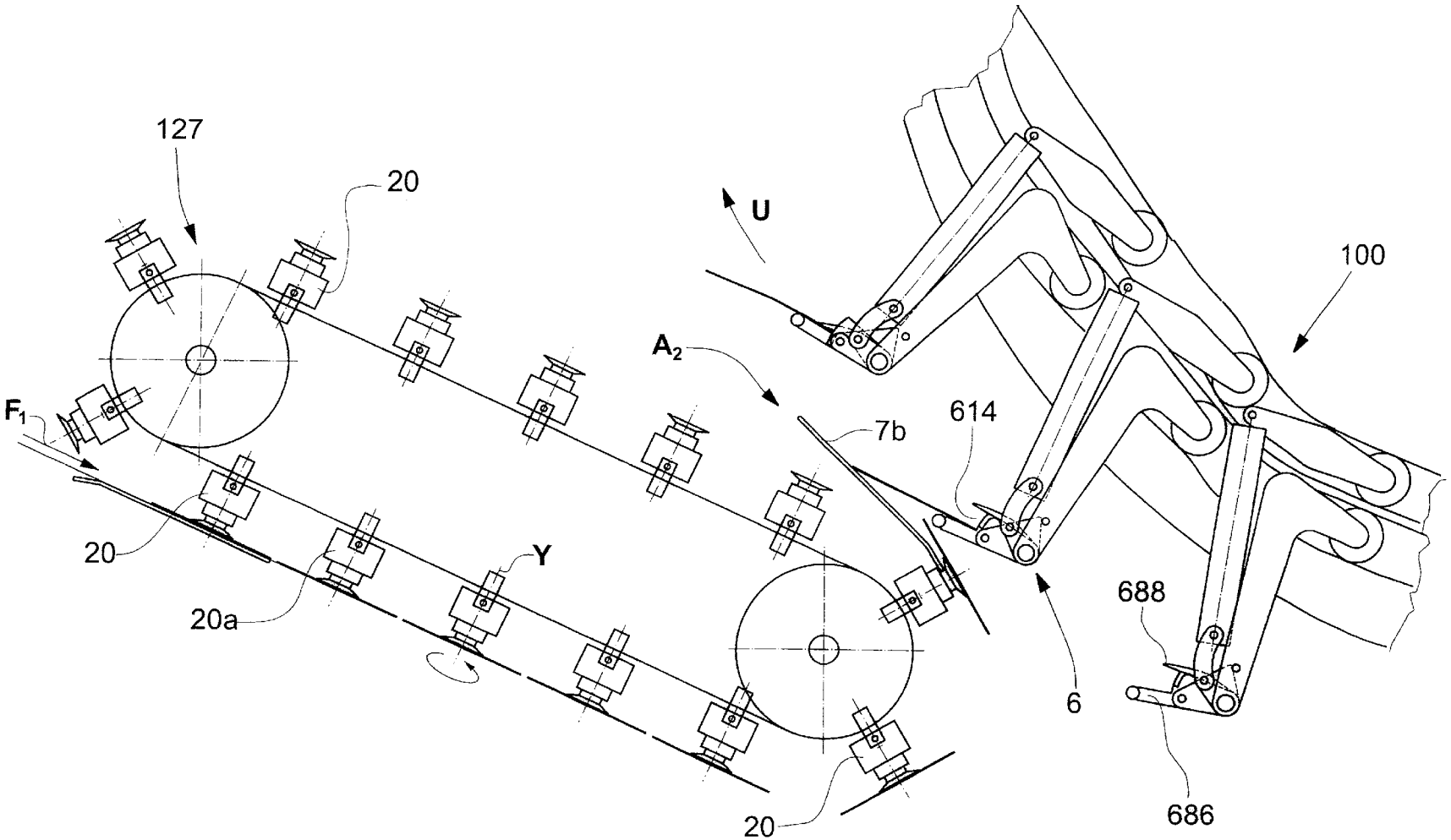
FIG. 6*a* shows an illustration corresponding to FIG. 6, with a second variant of the first conveyor.
Figure 6B:
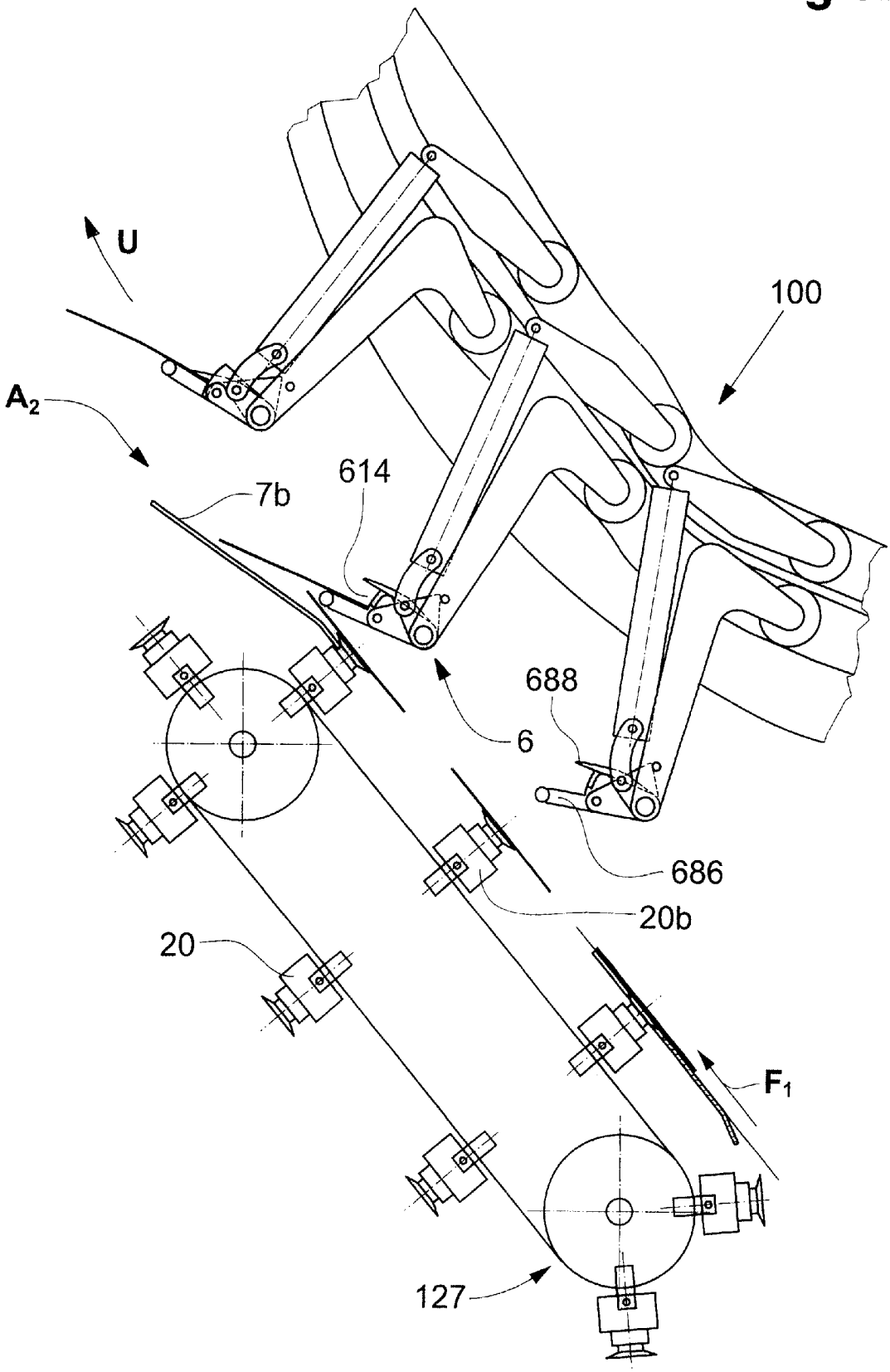
FIG. 6*b* shows an illustration corresponding to FIG. 6, with a third variant of the first conveyor.

As is illustrated in FIGS. 6*a* and 6*b*, it is possible for the retaining elements 20, which are configured as suction tools and are each mounted in a bearing body 22 such that they can be rotated about the axis y, to be assigned, rather than to the rotor 27 which is known from FIG. 4, to a circulatory conveyor 127 with a continuous circulatory path. In this case too, the rotary movement of the retaining elements 20, which transport the supplementary products 1, is controlled by a guidance means (not illustrated) which can be switched on and switched off and/or switched over.

In that arrangement of the circulatory conveyor 127 which is illustrated in FIG. 6*a*, the supplementary products 1 are gripped on their top side by the retaining elements 20, in the bottom region of said conveyor, and then deflected upward, by the circulatory conveyor 127—as was similarly done by the rotor 27—by way of their underside. The rotation of the supplementary products 1 about the axis y, which is perpendicular to the circulatory path, takes place before said deflecting operation, for example by rotation of the retaining element designated 20*a* in FIG. 6*a*.

In that arrangement of the circulatory conveyor 127 which is illustrated in FIG. 6*b*, the supplementary products 1 are gripped on their underside, in the top region of said conveyor, and also released on the bearing element 7*b* by way of said underside, it being possible for the supplementary products 1 to have been rotated previously by a desired angle of rotation (for example by rotation of the retaining element designated 20*b*).

Of course, it is also possible for the transporting apparatus 10 according to the invention to be used for transportation of supplementary products 1 which are present in stacked form at the receiving location. In this case, an individual supplementary product 1 may be raised by an auxiliary tool, an additional sucker or a severing cutter or gripped directly by a retaining element 20*a*, 20*b*, 20*c*, 20*d*.

It is thus possible for the supplementary products 1,1', 1" to be fed and prepared by any desired first conveying arrangements 2, 2', 2", transported, and moved into a necessary position, by the transporting apparatus 10 according to the invention and processed further by any desired second and further conveying arrangements 100, 1000.

It is also possible for supplementary products which are not provided with an adhesive layer to be advantageously transported, and moved into a desired position, by the transporting apparatus 10 according to the invention. The supplementary products are preferably relatively lightweight printed products, for example notes in the manner of post-it® products, content-filled trade samples or information leaflets, which are to be connected to the printed products.

As has already been mentioned, the transporting apparatus 10 is preferably synchronized with the first and second conveyors 2; 100 such that smooth transfer of the supplementary products 1 is possible.

Of course, it is also possible for the transported supplementary products 1 to be provided directly on printed products, or other products, at the discharge location A2 by the transporting apparatus 10.

Furthermore, it is also possible to transport supplementary products 1 which are not coated with adhesive and are inserted into printed products or other products (e.g. an advertising leaflet in a newspaper).

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. An apparatus for transporting sheet-like supplementary products, provided in particular with adhesive, from a receiving location to a discharge location, comprising:

at least one retaining element which is moved along a continuous circulatory path and by means of which supplementary products can be gripped at the receiving location and released again at the discharge location, wherein the retaining element is mounted such that it can be rotated about an axis which is located at least more or less perpendicularly to the circulatory path; and, a control arrangement for said retaining element which is selectively adjustable so that, during the transportation of the retaining element from the receiving location to the discharge location, said control arrangement optionally leaves said retaining element unchanged in one rotary position or rotates it about the axis through a certain angle until another position of the transported supplementary product has been reached;

wherein the control arrangement has a guidance element and a slide interacting with the retaining element and, during the movement of the retaining element along the circulatory path, said slide follows the surface of the guidance element in contact therewith and rotates the retaining element about the axis.

2. The apparatus as claimed in claim 1, wherein the retaining element is mounted rotatably in a bearing body which is moved along the circulatory path and wherein the slide is mounted displaceably in the bearing body.

3. The apparatus as claimed in claim 2, wherein the supplementary products can be rotated through 90° between receiving location and discharge location by means of said control arrangement.

4. The apparatus as claimed in claims 1, 2 or 3, wherein the control arrangement is selectively adjustable to change the angle of rotation through which the retaining element is rotated during the transportation from the receiving location to the discharge location.

5. The apparatus as claimed in claim 4, wherein a plurality of retaining elements are arranged at regular intervals one behind the other on a continuous drawing element or on a rotor disk rotating about an axis or on rotor arms of a rotor rotating about the axis.

6. The apparatus as claimed in claim 5, wherein the retaining elements are configured as suction elements or grippers and are respectively intended for attaching the supplementary products by suction or for gripping the same.

7. The apparatus as claimed in claims 1, 2 or 3, wherein provided at the receiving location is a first supporting element, on which the supplementary products are deposited by a first conveyor and are gripped individually by means of the retaining elements, and wherein provided at the discharge location is a second supporting element, on which the transported supplementary products are deposited and are held ready for being received by a second conveyor.

8. The apparatus as claimed in claim 7, wherein the retaining elements are configured as suction elements having a hollow shaft which is mounted rotatably in the bearing body and of which the radially outwardly directed end is provided with a suction head, which is suitable for gripping supplementary products, and the end which is directed toward the circulatory path is connected pneumatically to a controllable compressed-air apparatus.

9. The apparatus as claimed in claim 8, wherein the compressed-air apparatus is capable of producing a negative pressure in the hollow shaft by virtue of the air in the line, which is connected to the hollow shaft, being extracted by suction, or by virtue of air being conducted through the line at an elevated flow speed by way of an ejector, to which the hollow shaft is coupled pneumatically.

10. The apparatus as claimed in claim 9, wherein the hollow shaft has a radial toothing formation in which the slide, which can be displaced at least more or less parallel to the circulatory path and/or to the axis, engages with a form fit.

11. The apparatus as claimed in claim 10, wherein there is provided a first conveyor by means of which the retaining elements can be fed supplementary products which can be separated off from at least one of a stack or a band or carrier band at the receiving location.

12. The apparatus as claimed in claim 11, wherein the supplementary products are provided with at least one of an adhesive layer and printing during the transporting operation.

13. The apparatus as claimed in claim 12, wherein the supplementary products can be gripped by transporting clamps of a second conveyor at the discharge location.

14. The apparatus as claimed in claim 13, wherein the grip changes the supplementary products and at least one of discharge them into or attach them to printed products in a processing arrangement.

15. The apparatus as claimed in claim 14, wherein the retaining elements can be activated individually.

16. A process for transporting sheet-like supplementary products, provided with adhesive, from a receiving location to a discharge location, comprising the steps of: gripping the supplementary products by means of a retaining element, which is moved along a continuous circulatory path, at the receiving location and releasing them at the discharge location, wherein, during the transportation from the receiving location to the discharge location, the retaining element is mounted such that it can be rotated about an axis which is located at least more or less perpendicularly to the circulatory path; and controlling the retaining element as it moves with a guidance element following a slide and interacting with the retaining element whereby the retaining element is optionally left unchanged in a rotary position or rotated about the axis through a certain angle until a selected end position of the transported supplementary product has been reached.

17. The process as claimed in claim 16, wherein the supplementary products, which are fed to a first conveyor in a first position, are gripped, transported to the discharge location and discharged there, as appropriate, to a second conveyor in a second position, which is suitable for further processing.

18. The process as claimed in claim 17, wherein the conveying directions of at least one of the first and the second conveyor and of the retaining elements are located in one plane.

19. An apparatus for transporting sheet-like supplementary products, provided in particular with adhesive, from a receiving location to a discharge location, comprising:

at least one retaining element which is moved along a continuous circulatory path and by means of which supplementary products can be gripped at the receiving location and released again at the discharge location, wherein the retaining element is mounted such that it can be rotated about an axis which is located at least more or less perpendicularly to the circulatory path; and, a control arrangement for said retaining element which is selectively adjustable so that, during the transportation of the retaining element from the receiving location to the discharge location, said control arrangement optionally leaves said retaining element unchanged in one rotary position or rotates it about the axis through a certain angle until another position of the transported supplementary product has been reached;

wherein the retaining element is mounted rotatably in a bearing body which is moved along the circulatory path, wherein the control arrangement has a guidance element and a slide which is mounted displaceably in the bearing body and, during the movement of the retaining element along the circulatory path, said slide follows the surface of the guidance means in contact therewith, and correspondingly rotates the retaining element about the axis.

20. The apparatus as claimed in claim 19, wherein the supplementary products can be rotated through 90° between receiving location and discharge location by means of said control arrangement.

* * * * *

UNITED STATES PATENT AND TRADEMARK OFFICE

CERTIFICATE OF CORRECTION

PATENT NO. : 6,520,496 B2 
DATED : February 18, 2003
INVENTOR(S) : Erwin Müller et al.

It is certified that error appears in the above-identified patent and that said Letters Patent is hereby corrected as shown below:

Column 10,
Lines 27-28, delete "grip changes" and substitute -- clamps grip -- in its place.

Signed and Sealed this

Fourteenth Day of October, 2003

JAMES E. ROGAN
*Director of the United States Patent and Trademark Office*